US005421762A

United States Patent [19]

Glickman

[11] Patent Number: 5,421,762

[45] Date of Patent: Jun. 6, 1995

[54] VEHICLE TRACK FOR CONSTRUCTION TOY SYSTEM

[75] Inventor: Joel I. Glickman, Huntingdon Valley, Pa.

[73] Assignee: Connector Set Limited Partnership, Hatfield, Pa.

[21] Appl. No.: 101,422

[22] Filed: Aug. 3, 1993

Related U.S. Application Data

[63] Continuation-in-part of Ser. No. 19,066, Feb. 18, 1993, and a continuation-in-part of Ser. No. 759,400, Sep. 13, 1991, Pat. No. 5,238,438.

[51] Int. Cl.[6] ..... A63H 33/26

[52] U.S. Cl. ..... 446/126; 446/124; 446/446

[58] Field of Search ..... 446/85, 93, 96, 108, 446/111, 120, 122, 444, 445, 446, 489, 124, 126; 104/140, DIG. 1; 52/295

[56] References Cited

U.S. PATENT DOCUMENTS

| | | | |
|---|---|---|---|
| 2,782,730 | 2/1957 | Frank | 446/447 X |
| 3,541,724 | 11/1970 | Einfalt | 101/140 X |
| 3,698,130 | 10/1972 | Usami | 446/445 |
| 3,699,711 | 10/1972 | Coffey, Sr. | 446/445 |
| 4,571,204 | 2/1986 | Wang | 446/445 X |
| 5,118,320 | 6/1992 | Miller | 446/445 X |

*Primary Examiner*—Sam Rimell

*Attorney, Agent, or Firm*—Schweitzer Cornman & Gross

[57] ABSTRACT

A construction toy system is disclosed for the assembly of a guide track structure for a wheeled vehicle. Basic structural components, comprising rod-like struts and molded plastic connector elements adapted for snap-together attachment to the strut elements, enable support structures to be assembled. One or more guide track elements is provided, preferably in the form of a continuous, slotted flexible tube, typically formed by extrusion of plastic material. Special track-mounting connector elements are formed with track-mounting lugs which extend through the slotted side of the tubular track element to provide internal support. Track-mounting lugs are positioned at spaced points throughout the structure, providing spaced support for the track element. The flexible track element is self-supporting between mounting lugs, and conforms readily and smoothly to vertical and horizontal contours of the structure. For structures utilizing spaced-apart rails, strut elements are formed with spacing abutments, providing fixed and uniform spacing between rail elements throughout an extended structure.

13 Claims, 5 Drawing Sheets

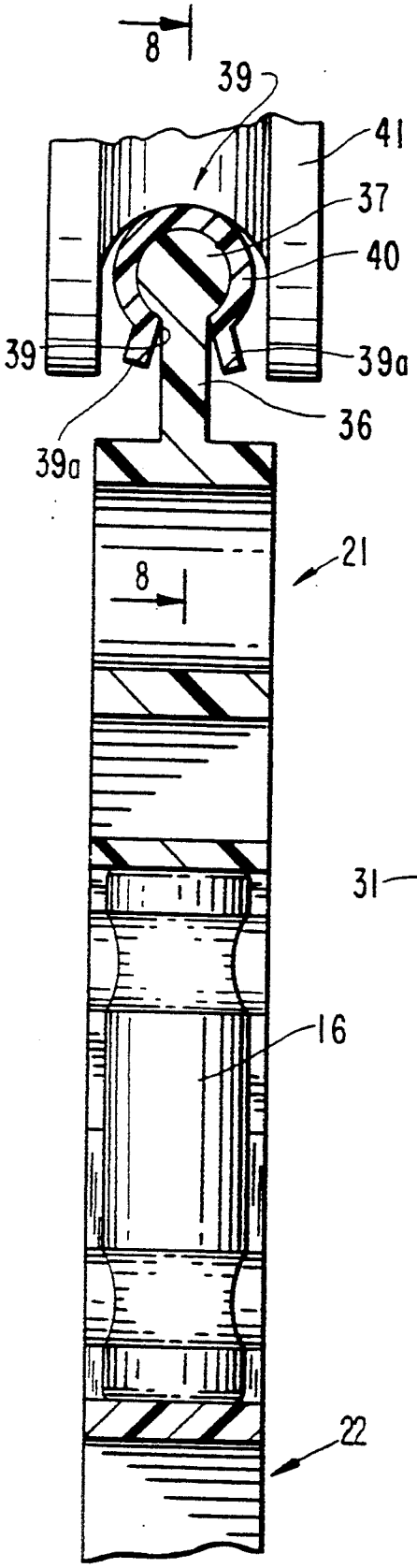
FIG. 7
FIG. 8
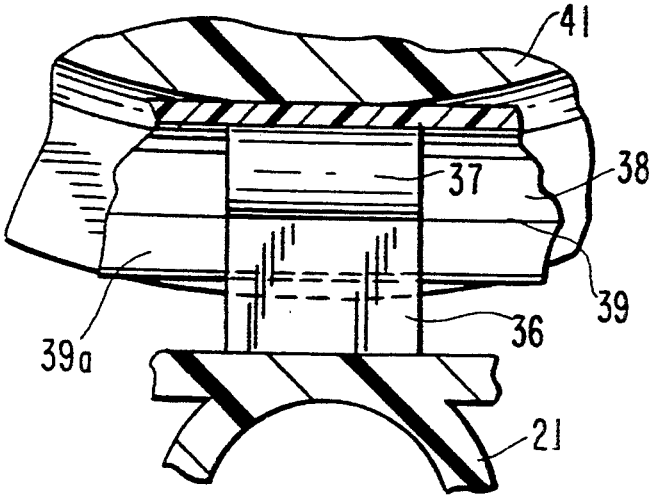
FIG. 9
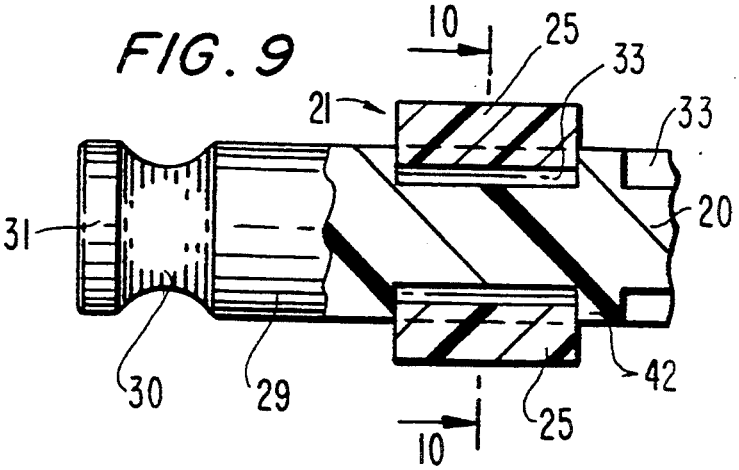
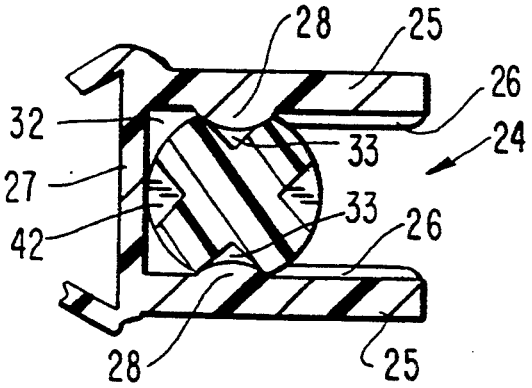
FIG. 10

VEHICLE TRACK FOR CONSTRUCTION TOY SYSTEM

RELATED APPLICATIONS

This application is a continuation-in-part of my copending application Ser. No. 019,066, filed Feb. 18, 1993, and of application Ser. No. 759,400, filed Sep. 13, 1991. The application is also closely related to the earlier Glickman U.S. Pat. No. 5,061,219, granted Oct. 29, 1991, U.S. Pat. No. 5,199,919, granted Apr. 6, 1993, and U.S. Pat. No. 5,137,486, granted Aug. 11, 1992.

BACKGROUND AND SUMMARY OF THE INVENTION

This invention is based upon a novel construction toy system as described and claimed in the above mentioned pending applications and issued patents owned by Connector Set Limited Partnership. In general, the basic construction toy system is comprised of a novel strut and connector system in which connectors are provided with open-sided sockets for the lateral reception and substantially rigid retention of end portions of rod-like strut elements. The sockets of the connector elements are defined by spaced-apart gripping arms formed with axially extending grooves which engage and grip opposite sides of a strut adjacent its end to align and firmly hold the strut along a predefined axis. One or more locking elements project from the gripping arms partially into the socket area, and these are received in grooves formed on the ends of the struts, such that the struts, when engaged by the gripping arms, are locked against axial motion by cooperation between the projections and grooves. Desirably, the struts are provided with longitudinally extending opposed grooves designed for cooperation with the locking projections formed on the gripping arms of the connector elements. This arrangement enables the struts to be pressed crosswise into the gripping sockets, until the locking projections are snapped into the opposed longitudinal grooves, thus firmly locking the strut in a crosswise orientation in the connecting element.

The above described construction toy system enables large and complex three-dimensional structures to be assembled in virtually limitless variety. The present invention enables the incorporation, in a structure assembled using the described construction toy system, of a simplified track structure for the guided movement of a vehicle. To this end, the system incorporates specially modified connector elements which, in addition to forming part of an underlying structure, also mount and support guide rails forming a vehicle guide track. The system of the invention enables guide tracks to be designed with portions arranged in a straight line manner, and with other portions formed with horizontal curves and vertical contours. By way of example, a representative structure specifically illustrated herein is in the form of roller coaster, which easily illustrates the manner in which the invention can be employed.

To particular advantage, the track system of the invention utilizes, for the rail elements of the track structure, generally continuous lengths of modified flexible plastic tubing, which is slotted lengthwise. Special connector elements, provided for mounting and supporting the rail elements, are formed with integral mounting lugs, each including an upwardly projecting stem portion and an enlarged head portion. The rail elements can be assembled to their supports by applying the slotted side of the tubing over the mounting lugs, so that the interior of the tubular rail section is supported by the head portions of the mounting lugs, and the rail section is spaced above the connector element by the stem portion, which passes through the slotted sidewall of the rail. In a typical track structure, rail-supporting connector elements are spaced apart longitudinally, and the rail sections are self-supporting in the spaces between longitudinally adjacent connector elements.

For a more complete understanding of the above and other features and advantages of the invention, reference should be made to the following detailed description of a preferred embodiment of the invention and to the accompanying drawings.

DESCRIPTION OF THE DRAWINGS

FIG. 7 is an enlarged fragmentary cross sectional view as taken generally on line 7—7 of FIG. 2.

FIG. 8 is an enlarged fragmentary cross sectional view as taken generally on line 8—8 of FIG. 7.

FIG. 9 is an enlarged fragmentary cross sectional view as taken generally on line 9—9 of FIG. 2.

FIG. 10 is a fragmentary cross sectional view as taken generally on line 10—10 of FIG. 10.

DESCRIPTION OF PREFERRED EMBODIMENTS

Figure 1:
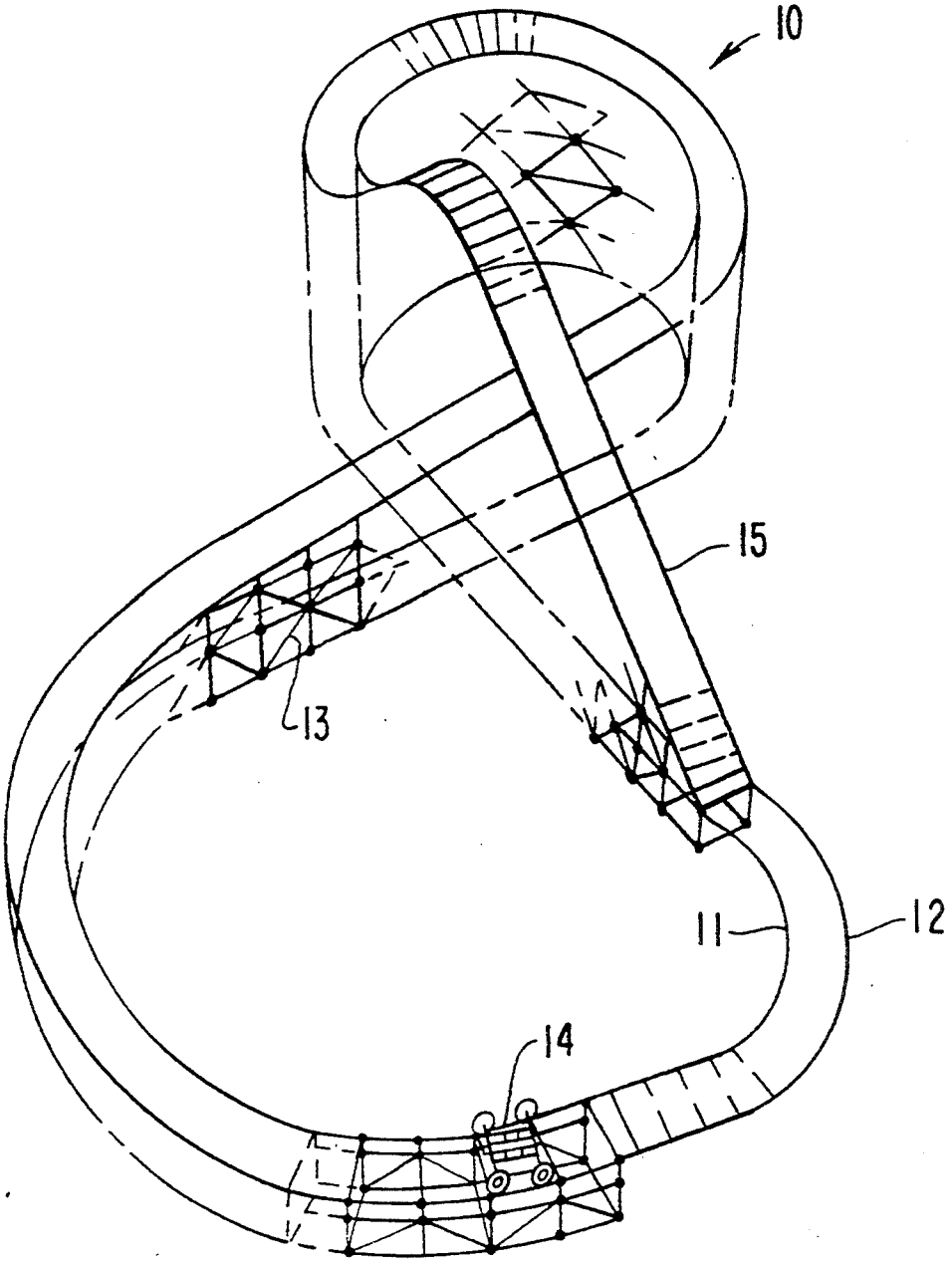
FIG. 1 is a schematic perspective illustration of a simple roller coaster structure constructed in accordance with the invention.

Referring now to the drawing, the reference numeral 10 (FIG. 1) represents generally a typical structure employing the features of the invention. In the illustrated instance, the structure 10 is a roller coaster comprised of spaced-apart rails 11, 12 mounted on a skeletal structure 13 comprised of rod-like struts and connector elements, preferably according to the principles and disclosures of the before mentioned Glickman United States patents. The rails 11, 12 are spaced-apart uniformly over their entire length, forming a two-rail guide track for one or more wheeled vehicles 14. In a structure such as shown in FIG. 1, a motorized or manual lift device (not shown) desirably is provided for carrying the vehicle 14 up an inclined portion 15 of the structure. When the vehicle reaches the top of the incline, it is released and returns by gravity to the bottom of the incline.

Figure 2:
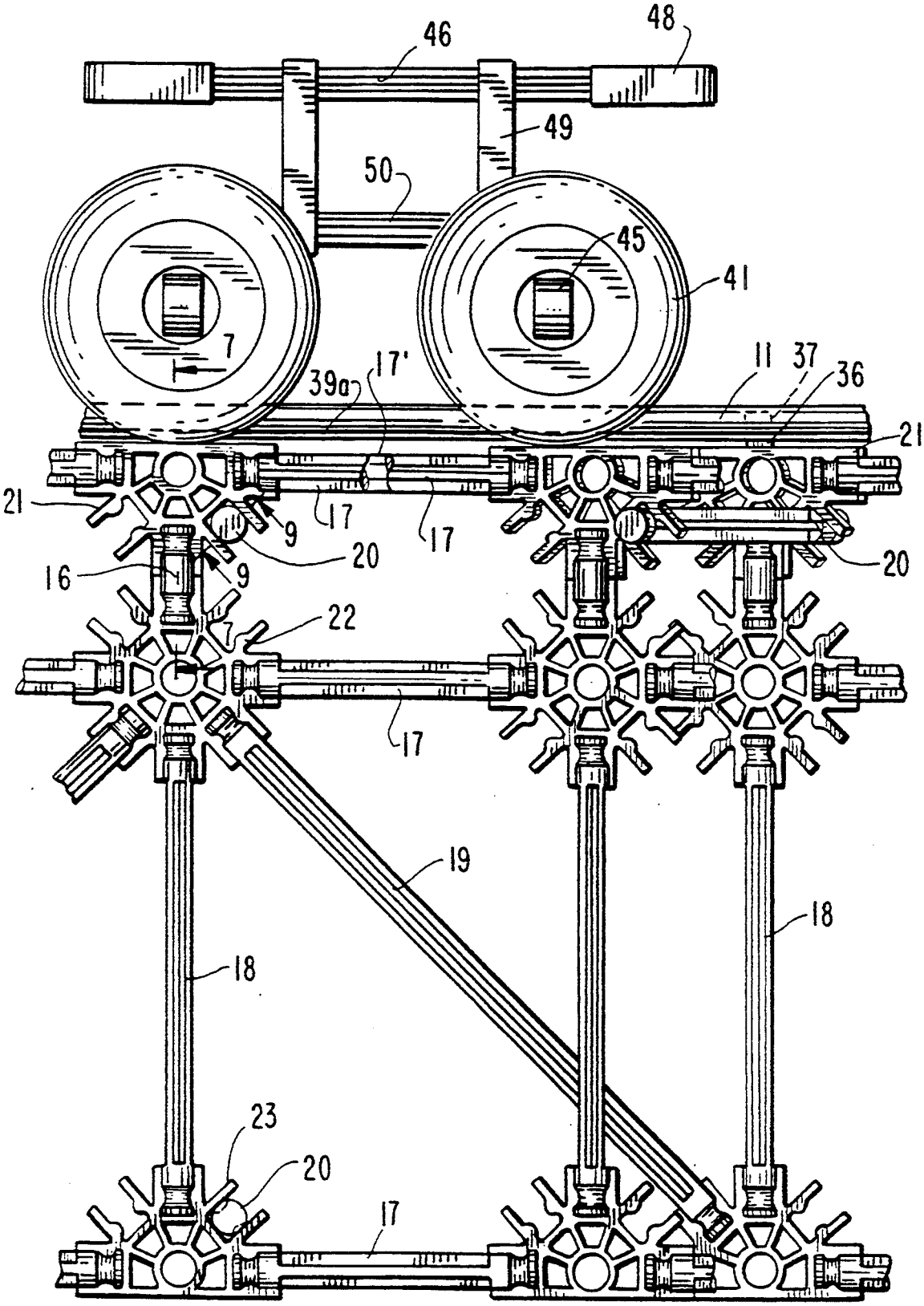
FIG. 2 is an enlarged, fragmentary view showing a section of the structure of FIG. 1.
Figure 3:
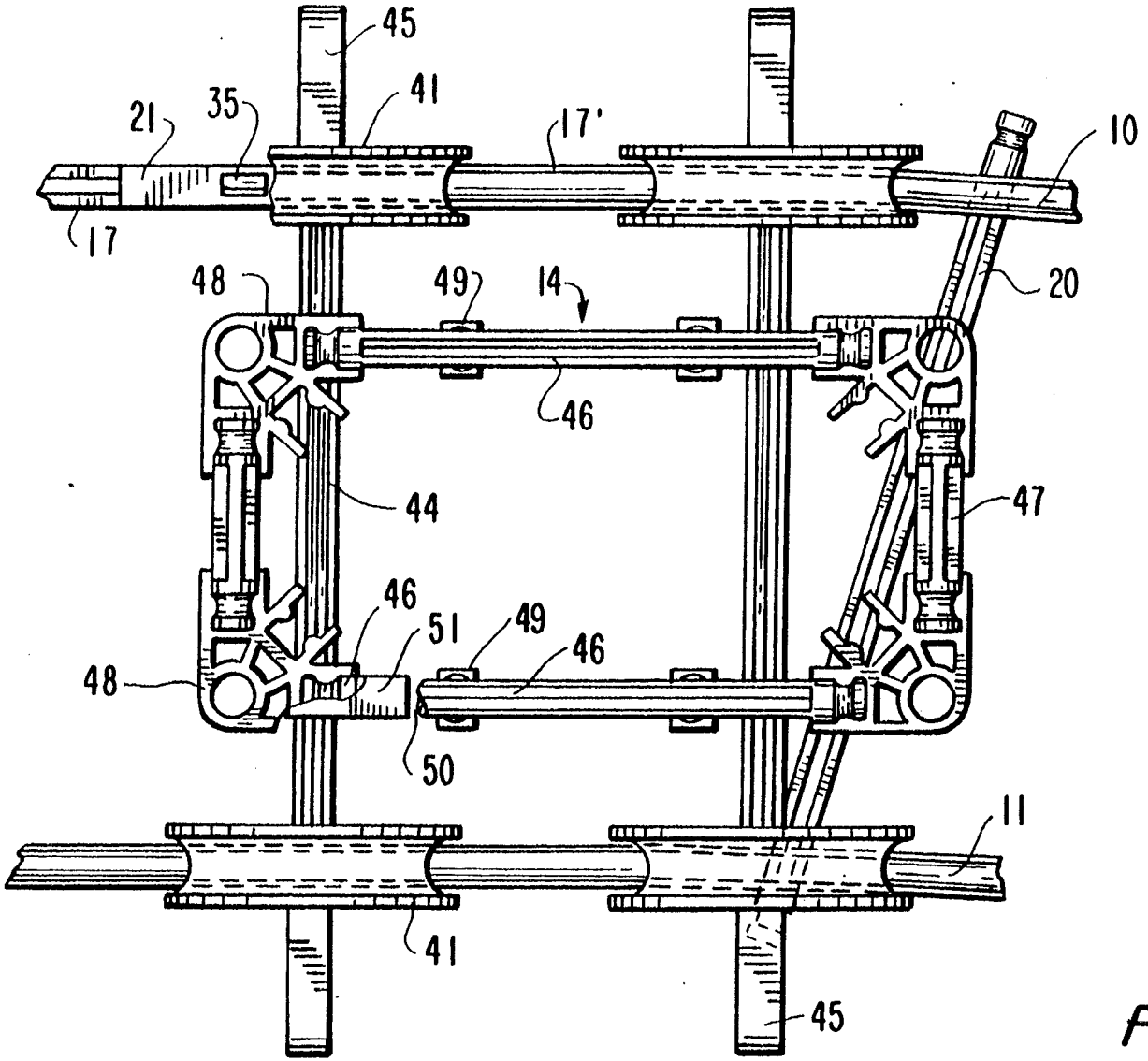
FIG. 3 is a top plan view of the structural segment of FIG. 2.

With reference to FIGS. 2 and 3, a rail-supporting structure of suitable configuration may be assembled utilizing a plurality of struts 16–19 and transversely disposed spacing struts 20, joined with connector elements 21–23. Pursuant to principles of my before mentioned patents, the connector elements are preferably formed of molded plastic and are provided with a plurality of strut-engaging sockets 24 (FIG. 10). The sockets 24 are comprised of spaced-apart gripping arms 25 formed with axially extending grooves 26. The sockets 24 are open at one end and closed at the other by an end wall 27. Locking projections 28, integral with the gripping arms 25, project slightly into the socket space forming a constriction.

As shown in FIG. 9, the several strut elements are provided at each end with a configuration complementary to the sockets 24. In particular, in a preferred form the strut end includes a cylindrical section 29, an annular grooved portion 30, and an end flange 31. The end flanges 31 are adapted to be closely received in an end chamber 32 in the connector socket, formed between the end wall 27 and the locking projections 28. The projections 28 are designed to closely conform to the annular groove 30 in the strut, and the cylindrical portions 29 of the struts are adapted to be received in and gripped by the axially grooved portions 26 of the gripping arms 25. Normal attachment of a strut to a connecting element involves a lateral snap-in assembly in which the strut end is forced laterally into an open side of the socket 24, with the gripping arms 25 temporarily flexing outward sufficiently to enable the cylindrical portions 29 of the strut to enter into the grooved portions 26. The strut is then firmly gripped and positioned in the socket.

As shown in FIG. 10, a strut can also be inserted into the socket in a crosswise orientation. To this end, central portions of the strut elements are formed with opposed grooves 33, running lengthwise along the struts. The positioning of the locking projections 28, in relation to the end wall 27 of the sockets, is such that, when a crosswise oriented strut is pressed into the open end of a socket 24, it can be pressed deep enough into the socket that the locking projections 28 snap into the longitudinal grooves 33, locking the strut firmly in its crosswise orientation.

As is reflected in the above mentioned patents, the connector elements can be provided in a variety of configurations, with multiple strut-receiving sockets radiating in a single plane, or in multiple planes, to accommodate a wide variety of structural possibilities.

In the specific structure shown in the drawings, which is illustrative and not in any way limiting of the multitude of possibilities, a structural base is formed by a plurality of flat-sided base connectors 23 joined by horizontal, longitudinally extending struts 17. In general, it is desired that the connector elements 23 be arranged in transversely opposed pairs, as shown in FIG. 3, and these may be joined by transverse spacing struts 20 received crosswise in the connector elements. In the illustrated arrangement, an elevated structure is formed using vertical struts 18, which extend from the base connectors 23 to intermediate connector elements 22. Longitudinally adjacent ones of the intermediate connectors 22 are joined by horizontal struts 17 of the same length as directly below.

Figure 4:
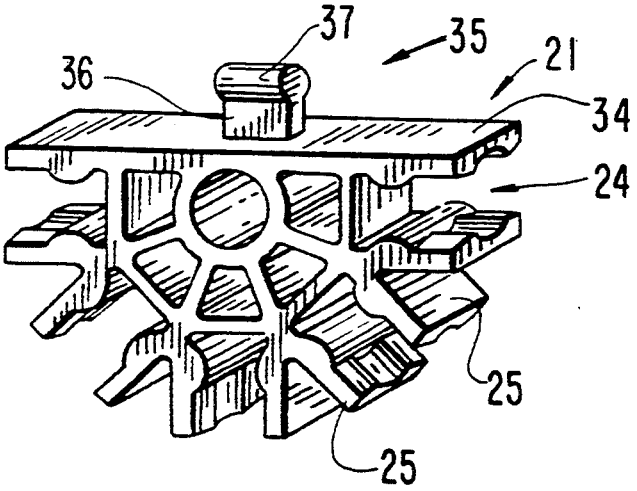
FIG. 4 is a perspective illustration of one preferred form of rail-mounting connector element according to the invention.

In the arrangement illustrated in FIG. 2, short struts 16 join the intermediate connector 22 with upper, rail-supporting connectors 21 incorporating features of the present invention. The connectors 21 are, in general, similar to the flat-sided base connectors 23. However, as shown in FIGS. 4 and 7, a rail-mounting lug 35 projects upward from the flat sidewall 34 of the connector. The lug 35 desirably is integral with the molded connector element 21 and is comprised of an upwardly projecting relatively flat, thin stem portion 36 and an enlarged head portion 37, which typically will be of cylindrical cross section. The rail-mounting lug 35 preferably is of relatively short length (measured horizontally in FIG. 4) in comparison with the overall length of the flat sidewall 34.

Figure 6:
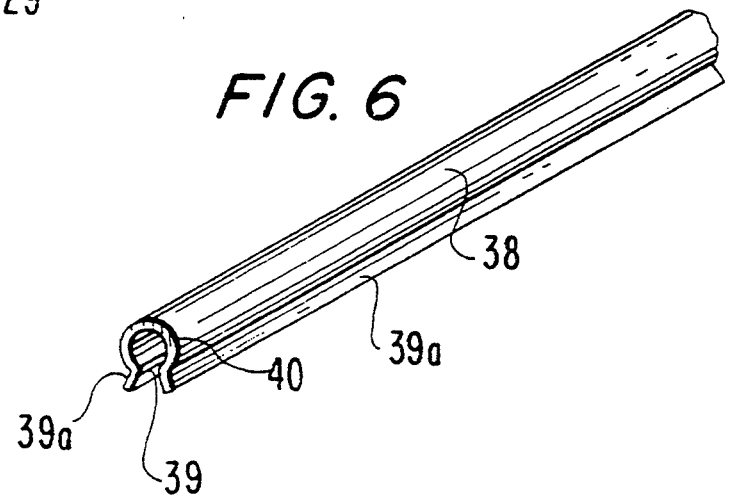
FIG. 6 is a perspective view of a section of rail utilized in the structure of the invention.

Cooperating with the rail-mounting lugs 35 are special rail elements 38, shown in FIG. 6 (and constituting the rail elements 11, 12 of FIG. 1). To particular advantage, the rail element 38 is an elongated section of extruded (or possibly molded) plastic tubing, which is formed with an open side 39 and continuous, divergent guide flanges 39a extending from its opposite edges. The tubing preferably is formed by extrusion of a flexible plastic material and, in an advantageous embodiment of the invention, has a hollow interior of approximately $\frac{1}{8}$ inch diameter and side walls 40 of approximately 1/32 inch in thickness. A suitable throat width for the slot-like opening 39 is approximately 0.06 inch.

In the illustrated form of the invention, the rail-mounting lugs 35 are sized and shaped to be complementary with the rail sections 38. To this end, the cylindrical head portions 37 of the mounting lugs of approximately $\frac{1}{8}$ inch diameter, to be received snugly within the $\frac{1}{8}$ inch internal opening of the tubing. The stem portions 37 may have a thickness of, for example, 0.063 inch, barely larger than the nominal width of the slot opening 39.

A complete track structure is made of a series of longitudinally joined connector elements 21, providing spaced-apart rail-mounting lugs 35. The rail sections 38 ideally are provided in more or less continuous lengths to provide for an uninterrupted rail over the entire length of the assembled structure. However, sections of rail can be joined in any suitable manner, or a single rail section may be joined end to end to form a closed loop. In many cases, it is sufficient merely to apply adjacent ends of a rail section to a common support lug 35. Alternatively, a thin rod-like connector plug (not shown) may be inserted into the abutted ends of adjacent rail sections in order to provide a smooth connection and transition.

A preferred material for the tubular rail sections 38 is polypropylene, but other materials may be employed. The stiffness/flexibility of the rail sections is not critical. For some structures, relatively straight, relatively rigid rail sections may be preferred. In others, relatively flexible sections may be preferred, and some structures may desirably employ a mixture of both relatively rigid and relatively flexible sections, depending upon contours of the structure.

In a typical rail-supporting structure, there may be both vertical and horizontal contours. Horizontal curves may be provided by joining adjacent rail-supporting connectors 21 at opposite sides of the structure using struts of different lengths. For example, in FIG. 3, longitudinally adjacent connectors 21 at the bottom of the figure are joined by a strut 17 of one size, whereas the corresponding connectors 21 at the opposite side (top of the figure) are joined by a strut 17′ of greater length. This causes the track structure to be curved slightly toward the bottom of the figure. A succession of such connections will cause the track structure to change directions significantly, as will be understood. Vertical contours may be imparted by employing vertical connecting struts of different size between the intermediate connectors 22 and the rail-supporting connectors 21. In the illustration of FIG. 2, for example, the rail-supporting connectors 21 are joined to the structure by struts 16 of minimum length. Over a succession of adjacent segments, the length of the connecting struts 16 may be progressively increased, to cause the track structure to be diverted upwardly. As is evident in FIG. 1, a structure of complex, compound contours may be easily assembled using struts of appropriate lengths to connect adjacent segments of the structure. By using relatively flexible rail sections 38, the contours of the tracks are smooth, with gradual transitions in changing from one direction to another.

Figure 5:
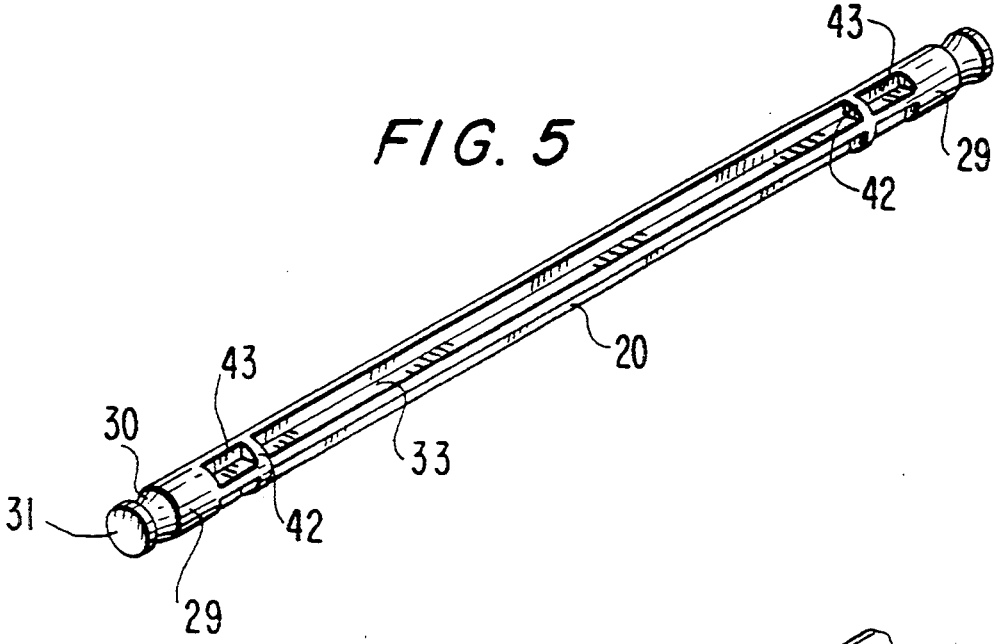
FIG. 5 is a perspective view of a preferred form of strut element employed in the construction of a track system, for maintaining uniform track spacing.

In any structure in which two or more parallel rails 10, 11 are employed to support a vehicle 14 having spaced-apart wheels 41, uniform horizontal spacing of the rails throughout is desirable. To this end, it is particularly advantageous to configure the transverse spacing struts 20 with spacing flanges 42 adjacent to but spaced from cylindrical end portions 29 of the spacing struts (see FIG. 5). The longitudinal grooves 33, which normally extend continuously from one end portion 29 to the other, are interrupted by the spacing flanges 42 to define locating sections 43. The length of the locating sections is approximately equal to, or slightly greater than the thickness of the connector elements 21, such that an opposed pair of gripping elements 25 can receive the strut 20 in a crosswise orientation within the limits of the spacing section 43. When the spacing strut 20 is thus joined with the connectors 21, the latter are accurately and uniformly spaced apart, so that the respective rails 11, 12 are maintained in relatively uniform horizontal spacing throughout the full extent of the track structure. The spacing struts 20 may of course be utilized in conjunction with any of the connector elements 22 or 23, at intermediate levels or at the base of the structure, as well as the rail-supporting elements at the top of the structure.

The track structure of the invention can be utilized with any wheeled vehicle having appropriately flanged wheels 41, as shown particularly in FIG. 3. In a typical assembly, pairs of the flanged wheels 41 are rotatably mounted on horizontal axle struts 44, using single socket connectors 45 at each end to retain the wheels on the struts. In the disclosed vehicle structure, which is merely illustrative, a vehicle body is made up of longitudinal struts 46 and transverse struts 47, joined at the corners by right angle connectors 48. Double-ended connectors 49 grip the longitudinal struts 46 and extend downward to engage longitudinal struts 50. Additional right angle connectors 51 are attached to the longitudinal struts 50 and to the axle struts 44 (see FIG. 3) to provide a rudimentary vehicle capable of rolling along the track structure.

As will be readily appreciated, the system of the invention enables a complex, contoured track structure to be assembled. The illustrated structure employs a two-rail track structure for supporting a vehicle having two or more wheels. Monorail and multiple rail structures are also possible with the system of the invention. A feature of particular advantage is the utilization of strut and connector assemblies, providing for lateral snap-in assembly of the struts and connectors to enable complex skeletal structures to be assembled, and wherein selected connector elements are provided with projecting mounting lugs for receiving and mounting, at spaced intervals, a tubular plastic (typically flexible) track element. Assembly of the basic structure proceeds in accordance with principles of the several Glickman U.S. patents mentioned above, utilizing at the appropriate locations special connectors having projecting rail-mounting lugs. Upon completion of the basic structure, the individual rails 11,12 are quickly and easily applied by either snapping the flexible rail element over the exposed ends of the rail-mounting lugs 35, or by "threading" the rail element onto the lugs in a linear fashion, advancing the end of the rail-forming tube individually over successive mounting lugs. Application of the rails over the mounting lugs 35 is facilitated by the divergent guide flanges 39*a*, which initially help to position the rail elements properly with respect to the mounting lugs and then to wedge open the throat sufficiently to allow the throat to pass over the enlarged head portions 37 of the mounting lugs.

The structure of the invention, which can employ to advantage substantially continuous, flexible rail elements, enables an endless variety of railed structures to be assembled. Utilizing a kit of multiple loose parts, provided in a variety of strut lengths and connector types, a virtually endless variety of structures may be assembled for the support and guidance of wheeled vehicles along a smoothly contoured guide track arrangement. Both monorail and parallel rail structures are possible using the system of the invention.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A track construction for a toy construction system which comprises (a) at least one section of tubing forming an individual rail element, (b) said section of tubing having a diameter and a length which is a large multiple of such diameter, (c) said section of tubing having outer walls and a hollow interior and having at least longitudinally spaced portions of its outer walls slit radially to provide access to said hollow interior at least at longitudinally spaced points along the length of said section, (d) a plurality of rail-mounting elements, (e) longitudinal spacing elements for securing a plurality of said rail mounting elements in longitudinally spaced relation, (f) said rail mounting elements each including one or more projecting lugs, each said lug including a stem portion and a head portion, (g) said head portions being insertable into the hollow interior of a section of tubing through a radially slit portion of its outer wall for securing said section of tubing along a predetermined path formed by said rail mounting elements.

2. A track construction according to claim 1, wherein (a) said tubing is formed of a flexible plastic material of hollow form and having a continuous opening along one side, and (b) integral, divergently related guide flanges extend outward from opposite sides of said opening.

3. A vehicle track structure for use in a construction toy system of the type comprising a plurality of rod-like strut elements and a plurality of molded plastic connector elements, each said connector element having a plurality of sockets for the snap-on reception and retention of said strut elements, said track structure comprising an assembly of such struts and connector elements, wherein (a) said connector elements have upper and lower portions, (b) said lower portions include a plurality of sockets arranged in an angularly spaced array for engagement with one or more strut elements, (c) the upper portions of said connector elements include one or more upwardly projecting integral rail mounting lugs, each having an upwardly projecting stem portion and an enlarged head portion, (d) there being at least two of said connector elements, (e) at least one strut element extending between and joining said at least two connector elements, to maintain said connector elements in a predetermined spaced-apart relation, (f) said track structure further including at least two rail members, (g) each of said rail members being of hollow construction to provide a hollow interior surrounded by a side wall, and having a restricted opening in said side wall, (h) each of said rail members being secured to a separate one of said spaced-apart connector elements by means of said rail mounting lugs, with the enlarged head portions of said lugs being received within the hollow interior of a rail member and the stem portions of said lugs passing through said restricted opening.

4. A vehicle track structure according to claim 3 wherein (a) said strut element includes end portions and intermediate portions extending between said end portions, (b) said sockets each comprising a pair of spaced-apart gripping arms adapted to grippingly engage a strut element disposed at right angles to said gripping arms, (c) said strut end portions forming first abutment stops for limiting movement of said gripping arms toward the ends of said strut element, (d) second abutment stops on said strut element, spaced from said first abutment stops a distance not substantially greater than the width of said gripping arms, (e) said first and second abutment stops serving to position a pair of connector elements in a predetermined spaced-apart relation on said strut element.

5. A vehicle track structure according to claim 4, wherein (a) said strut element has a generally cylindrical envelope, (b) said end portions are of generally cylindrically form and provided adjacent each end extremity with an annular groove, (c) said intermediate portions are formed with longitudinal grooves extending generally between said end portions, (d) said first abutment stops are formed by said generally cylindrical end portions, and (e) said second abutment stops are formed by generally cylindrical flanges formed on said strut elements and spaced from said first abutment stops.

6. A vehicle track structure according to claim 5, wherein (a) said gripping arms have outer portions formed with opposed, radially extending grooves adapted for the reception of a cylindrical end portion of a radially aligned strut element, (b) said gripping arms are further provided, adjacent said radially extending grooves and positioned radially inward thereof, opposed locking projections disposed at right angles to said grooves and projecting into a radially oriented socket space formed by said spaced-apart gripping arms and being locking engageable with the annular groove of a radially aligned strut element, (c) said locking projections being adapted to be grippingly received in longitudinally extending grooves in a strut element for locking engagement with a strut element oriented at right angles to a radially oriented socket space.

7. A vehicle track structure according to claim 3, wherein (a) said rail members are formed of flexible plastic material and are formed with a continuous opening on one side, and (b) integral guide flanges extend divergently outward from opposite sides of said continuous opening.

8. A track construction for a toy construction system which comprises (a) at least one section of tubing forming an individual rail element, (b) said section of tubing having outer walls and a hollow interior and having at least portions of its outer walls slit radially to provide access to said hollow interior at least at spaced points along the length of said section, (c) a plurality of rail-mounting elements, (d) longitudinal spacing elements for securing a plurality of said rail mounting elements in longitudinally spaced relation, (e) said rail mounting elements each including one or more projecting lugs, each said lug including a stem portion and a head portion, (f) said head portions being insertable into the hollow interior of a section of tubing for securing said section of tubing along a predetermined path formed by said rail mounting elements, (g) a pair of said rail elements being arranged in spaced-apart, parallel relation, (h) said rail-mounting elements being arranged generally in spaced-apart pairs, and (i) spacing struts extending between and connecting spaced-apart pairs of said rail-mounting elements.

9. A track construction according to claim 8, wherein (a) said longitudinal spacing elements connecting selected rail-mounting elements of an opposed pair thereof being of different length to impart horizontal curvature to a track formed of said rail elements.

10. A track construction for a toy construction system which comprises (a) at least one section of tubing forming an individual rail element, (b) said section of tubing having outer walls and a hollow interior and having at least portions of its outer walls slit radially to provide access to said hollow interior at least at spaced points along the length of said section, (c) a plurality of rail-mounting elements, (d) longitudinal spacing elements for securing a plurality of said rail mounting elements in longitudinally spaced relation, (e) said rail mounting elements each including one or more projecting lugs, each said lug including a stem portion and a head portion, (f) said head portions being insertable into the hollow interior of a section of tubing for securing said section of tubing along a predetermined path formed by said rail mounting elements, (g) said rail-mounting elements comprising connector elements of molded plastic construction and formed with at least one pair of spaced-apart gripping arms defining a socket-forming recess, (h) said gripping arms having outer portions formed with axial grooves facing into said recess, (i) rod-like strut elements are provided, having generally cylindrical end regions adapted to be received in and gripped in axial alignment by said gripping arms, (j) said gripping arms having intermediate portions formed with locking projections extending into and forming a restriction in said socket, (k) said strut elements having an annular groove adjacent an end thereof adapted for locking engagement with said locking projections.

11. A track construction according to claim 10, wherein (a) said rail mounting elements are formed with a plurality of radially disposed pairs of gripping elements, each said pair forming a socket recess adapted for the reception and gripping of an axially oriented strut element, (b) at least selected ones of said strut elements are of generally cylindrical outline and formed with at least one pair of longitudinally extending grooves, (c) said selected ones of said strut elements being adapted for crosswise reception in a socket recess of a rail-mounting element, with said locking projections being received in and lockingly engaged with said longitudinally extending grooves.

12. A track construction according to claim 11, wherein (a) said longitudinally extending grooves are terminated at each end by generally cylindrical end portions of said strut elements, and (b) generally cylindrical abutment stops are formed in said strut elements, spaced a predetermined distance from said generally cylindrical end portions, to form short, confined sections of said longitudinally extending grooves, (c) said strut elements being received crosswise in a socket of a rail-mounting element, with gripping arms of said rail-mounting element engaging said strut element in said confined sections of said longitudinally extending grooves.

13. A track construction for a toy construction system which comprises (a) at least one section of tubing forming an individual rail element, (b) said section of tubing having a diameter and a length which is a large multiple of such diameter, (c) said section of tubing having outer walls and a hollow interior and having at least longitudinally spaced portions of its outer walls cut radially to provide access opening means to said hollow interior at least at longitudinally spaced points along the length of said section, (c) a plurality of rail-mounting elements, (d) longitudinal spacing elements for securing a plurality of said rail mounting elements in longitudinally spaced relation, (e) said rail mounting elements each including one or more projecting lugs, each said lug including a projecting portion insertable into said access opening means and thereby into the hollow interior of a section of tubing for securing said section of tubing along a predetermined path formed by said rail mounting elements.

* * * * *